US005567273A

United States Patent [19]

Offerhaus et al.

[11] Patent Number: 5,567,273

[45] Date of Patent: Oct. 22, 1996

[54] METHOD OF REDUCING SURFACE IRREGULARITIES IN PAPER MACHINE HEADBOX COMPONENTS

[75] Inventors: Douglas H. Offerhaus; James E. Lilburn; Hugh D. Silver, all of Campbell River, Canada

[73] Assignee: Fletcher Challenge Canada Limited, Canada

[21] Appl. No.: 261,480

[22] Filed: Jun. 17, 1994

[30] Foreign Application Priority Data

Apr. 22, 1994 [CA] Canada ..... 2121967

[51] Int. Cl.[6] ..... D21F 1/32

[52] U.S. Cl. ..... 162/199; 162/198; 162/272

[58] Field of Search ..... 162/199, 198, 162/336, 344, 272, 262, 263

[56] References Cited

U.S. PATENT DOCUMENTS

| | | |
|---|---|---|
| Re. 28,269 | 12/1974 | Hill et al. . |
| 1,898,372 | 2/1933 | Hyde . |
| 4,551,204 | 11/1985 | Holik et al. . |
| 4,897,158 | 1/1990 | Weisshuhn et al. . |

OTHER PUBLICATIONS

"The Challenge, Lapping a Headbox Apron Floor" by D. H. Offerhaus; presented in Canada on 24 Apr., 1993; published in the proceedings of the 1993 Spring Conference, Canadian Pulp & Paper Association, Technical Section, Pacific Coast & Western Branches, Whistler, British Columbia, Canada, May 26–30, 1993.

"Continuing the Challenge, 'Blueprinting' a Headbox" by D. H. Offerhaus; presented in Canada on 23 Apr., 1994; published in the proceedings of the 1994 Spring Conference, Canadian Pulp & Paper Association, Technical Section, Pacific Coast & Western Branches, Jasper, Alberta, Canada, May 19–21, 1994.

*Primary Examiner*—Donald E. Czaja
*Assistant Examiner*—Calvin Padgett
*Attorney, Agent, or Firm*—Oyen Wiggs Green & Mutala

[57] ABSTRACT

A method of reducing surface irregularities in paper machine headbox components such as the apron floor. A lap having a working surface diameter greater than the dominant dimensional characteristic of the irregularities is provided. The lap's working surface is machined flat to a tolerance equivalent to a desired flatness tolerance of the apron floor. A central, circular portion of the lap's working surface is counterbored to define an outer, annular cutting region on the lap's working surface. The apron floor is levelly supported and measured to obtain an initial profile of surface irregularity as a function of position on the apron floor. The lap is then driven to rotate its cutting region levelly on and over the apron floor while abrasive material in solid form and a coolant are applied between the lap and the apron floor. The apron floor is again measured to obtain an updated profile of surface irregularity as a function of position on the apron floor. The lapping and measuring steps are repeated with progressively finer grades of abrasive material until comparison of the initial and updated profiles reveals attainment of the desired flatness tolerance of the apron floor. The procedure can be repeated at corner regions of the apron floor by substituting for the lap a corner lap having a working surface diameter significantly less than the apron floor width.

12 Claims, 11 Drawing Sheets

METHOD OF REDUCING SURFACE IRREGULARITIES IN PAPER MACHINE HEADBOX COMPONENTS

FIELD OF THE INVENTION

This application pertains to measurement and lapping techniques for reducing surface irregularities in paper machine headbox components in order to prevent streaking and other degradation of the paper produced.

BACKGROUND OF THE INVENTION

Paper machines are often subject to problems such as barring or streaking in the output paper sheet. In the prior art, such problems are conventionally addressed by techniques such as substitution of newer, more rigid headbox components; stiffening of the headbox support structure; alterations to the headbox approach and screen piping, changes to the headbox overflow piping; grinding and polishing of the fan pump internals; adoption of newer more flexible slice structures; etc. Although various combinations of these techniques can yield significant sheet quality improvements, problems such as streaking often remain.

The inventors have traced such problems to factors such as excessive surface irregularities (waviness) in headbox components, especially the apron floor. Conventionally, a headbox apron floor is finished in a sequence of planing (or milling), grinding, mechanical polishing and electro-polishing steps to produce a uniform flat surface. But, these time consuming steps do not appear to yield surfaces which are flat within the tolerances which the inventors believe to be desirable in overcoming the foregoing problems. The inventors have developed new techniques for measuring various paper machine headbox components to high degrees of accuracy; detected a need for more accurate machining of such components to tolerances which have not previously been attained; and, developed techniques for such machining which eliminate the need for mechanical or electro polishing.

SUMMARY OF THE INVENTION

In accordance with the preferred embodiment, the invention provides a method of reducing surface irregularities in paper machine headbox components, such as the apron floor, slice beam clamp face, etc. A lap having a working surface diameter greater than the dominant dimensional characteristic of the irregularities is provided. For example, if the irregularities are in the form of apron floor surface waviness, the lap's working diameter should exceed the dominant wavelength of such waviness. The lap's working diameter should also exceed the spacing between each pair of slice adjusters, since the adjusters cannot account for apron floor surface irregularities which occur between the adjusters. The lap's working surface is machined flat to a tolerance equivalent to a desired flatness tolerance of the apron floor. A central, circular portion of the lap's working surface is counterbored to define an outer, annular cutting region on the lap's working surface. The apron floor is levelly supported and measured to obtain an initial profile of surface irregularity as a function of position on the apron floor. The lap is then driven to rotate its cutting region levelly on and over the apron floor while abrasive material in solid form and a coolant are applied between the lap and the apron floor. The apron floor is again measured to obtain an updated profile of surface irregularity as a function of position on the apron floor. The lapping and measuring steps are repeated with progressively finer grades of abrasive material until comparison of the initial and updated profiles reveals attainment of the desired flatness tolerance of the apron floor. The procedure can be repeated at corner regions of the apron floor by substituting for the lap a corner lap having a working surface diameter significantly less than the apron floor width.

The lap is preferably stiff and rigid. It can advantageously be made of aluminum, have a thickness dimension of about 3 inches, and be round in shape. The lap is preferably driven by coupling a rotatable drive means to the lap through a universal joint.

The counterboring operation preferably comprises counterboring the central, circular portion of the lap to a depth of about ⅛ inch. Advantageously, a plurality of apertures are bored through the lap into the counterbored region. The coolant is applied through these apertures, into the counterbored region.

The abrasive material is preferably aluminum oxide in adhesive-backed pad form.

The apron floor profile can be measured by laser interferometry.

The invention further provides a method of reducing streaking in paper produced by a paper machine having a headbox apron floor. The apron floor is measured to obtain an initial profile of surface irregularity as a function of position on the apron floor. The apron floor is then lapped by driving a lap on and over the apron floor while applying abrasive material and coolant therebetween. The apron floor is again measured to obtain an updated profile of surface irregularity as a function of position on the apron floor. The lapping and measuring steps are repeated with progressively finer grades of abrasive material until comparison of the initial and updated profiles reveals attainment of a desired flatness tolerance of the apron floor.

The invention further provides a method of reducing streaking in paper produced by a paper machine having a headbox slice beam clamp face. The slice beam clamp face is measured to obtain an initial profile of surface irregularity as a function of position on the slice beam clamp face. The slice beam clamp face is then lapped by driving a lap on and over the slice beam clamp face while applying abrasive material and coolant therebetween. The slice beam clamp face is again measured to obtain an updated profile of surface irregularity as a function of position on the slice beam clamp face. The lapping and measuring steps are repeated with progressively finer grades of the abrasive material until comparison of the initial and updated profiles reveals attainment of a desired flatness tolerance of the slice beam clamp face.

DETAILED DESCRIPTION OF THE PREFERRED EMBODIMENT

The inventors investigated the problem of machine direction streaking of the sheet at a paper machine reel, where the problem was obvious for the machine in question. Here, the streaks showed up, in the form of high, hard annular bands, spaced across the spool. The locations of these streaks could, with practice, be felt by hand and confirmed by eye.

The approximate centre positions of streaks across the reel spool were measured and plotted on a streak location map, referencing them to headbox actuator positions. The streak map provided a historical basis for analysis, as various corrective actions were tried. The resulting information, compiled over a period of months, revealed that:

a) the presence and number of streaks was generally constant;
b) the streak locations remained constant, with only minor deviations;
c) the streak spacing was regular, with only minor deviations; and,
d) the streaks usually occurred between and not at actuator positions, tending to correlate with alternate slice actuator spacings.

Other features of the paper machine in question were checked, but found to have less correlation with the streak map. These include:

foil box, ceramic imperfections former section, shower spacing forming board, ceramic defects headbox stiffener rib locations headbox pitch deposits at apron floor joint slice clamp uneven spring pressures slice actuator rod ends, tapered groove misalignment.

Figure 1:
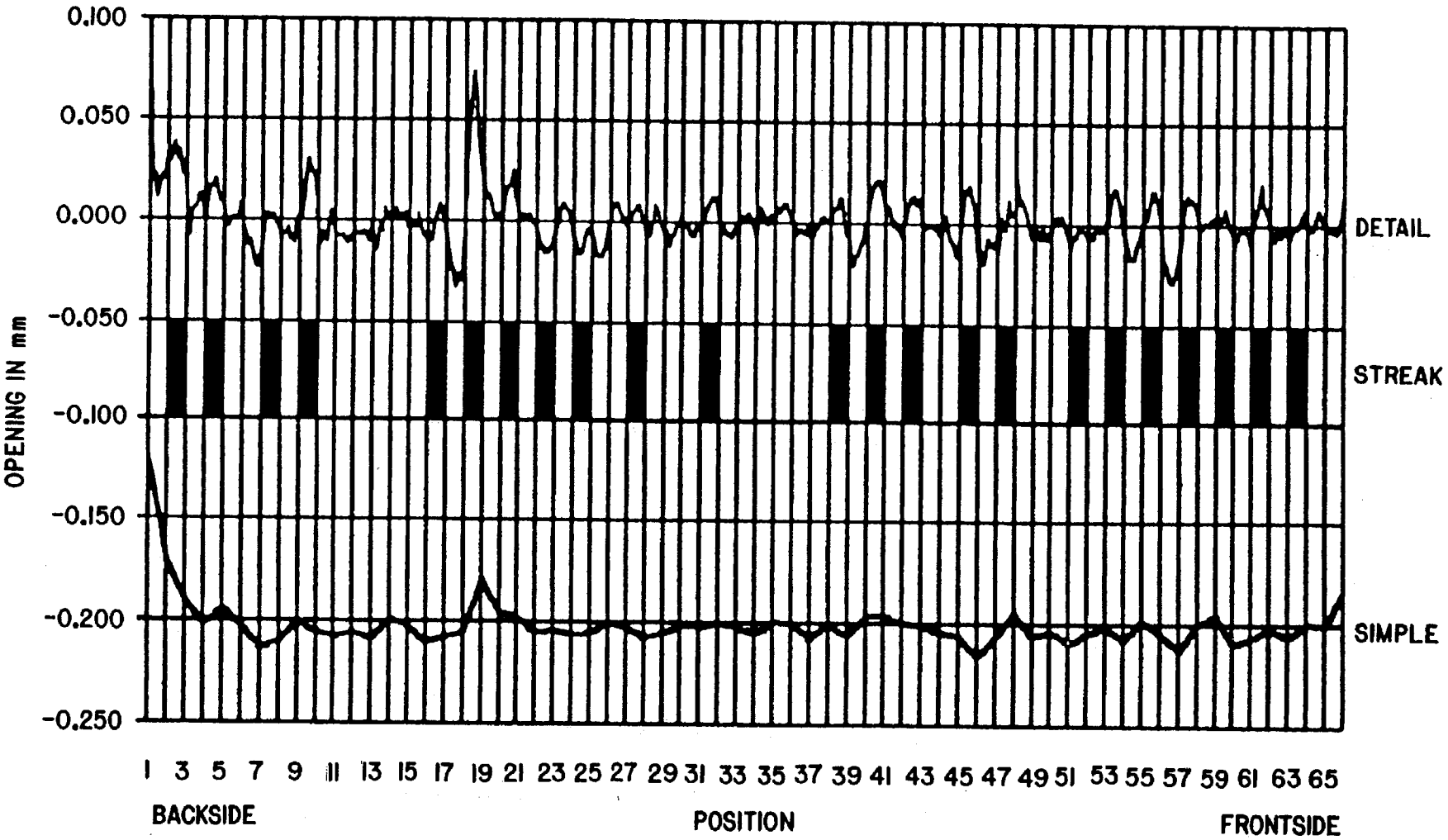
FIG. 1 is a graph depicting paper machine slice opening versus position, with streak locations superimposed, prior to lapping the apron floor.

Because the streaks were observed to relate to actuator spacings, the inventors studied the slice opening profile more carefully. Normally, the slice profile is measured and adjusted at each actuator rod position. This is based on the conventional assumption that the profile is linear between actuators. However, as shown in FIG. 1, significant peaks in the profile were discovered, typically between alternate sets of actuator positions, even with a brand new slice which had been carefully zeroed at each of the actuator positions. These positions had an 80% correlation with the locations of streaks showing up on the streak map. The magnitude of these deviations from a smooth slice, were in the order of 20–80 micrometers (0.0008"–0.003") peak to valley.

Figure 2:
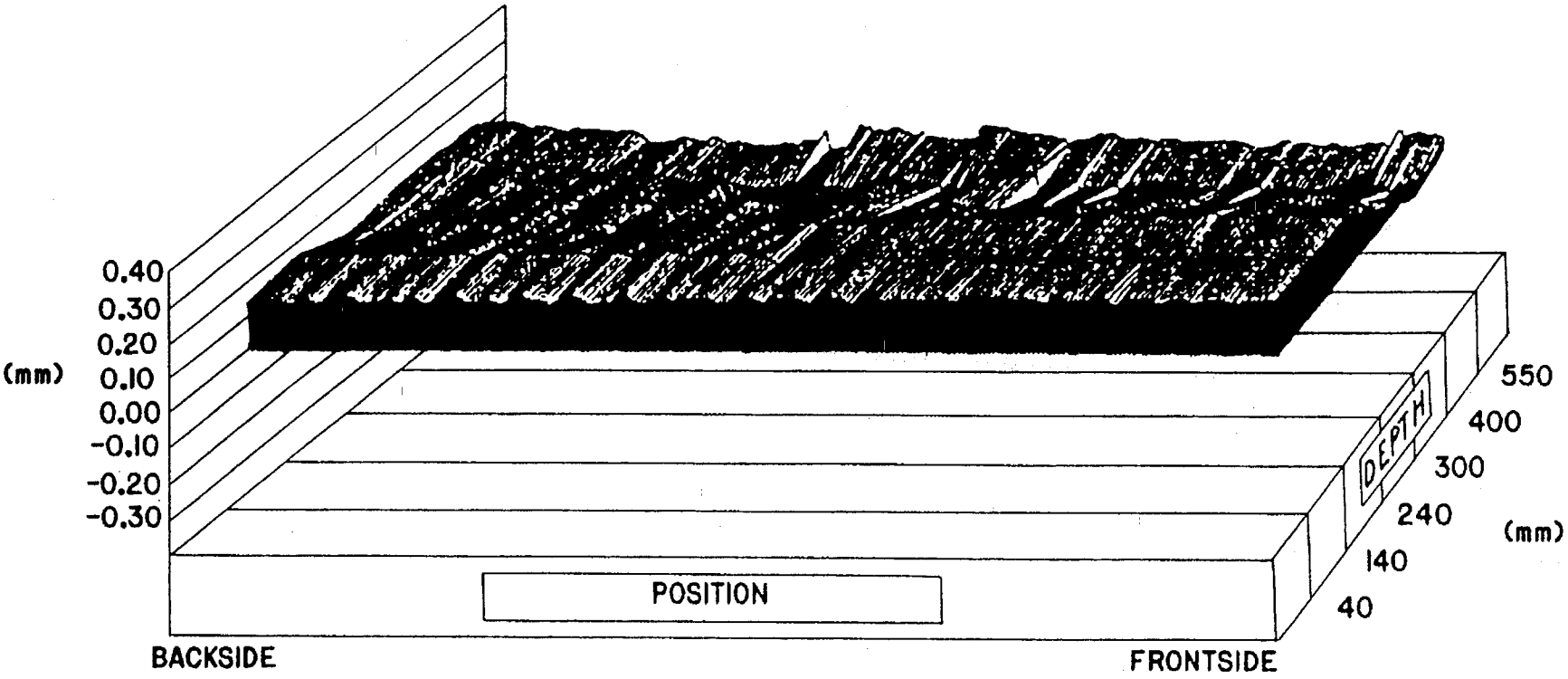
FIG. 2 is a three dimensional graph showing the profile of a paper machine apron floor measured in accordance with the invention, prior to lapping the floor.

The slice profiles were measured relative to the apron lip, which was arbitrarily assumed to be a flat reference datum. However, this assumption was also discovered to be incorrect. In particular, the profile of the headbox apron was measured independently of the slice and found to be wavy, with amplitudes of over 50 micrometers, (0.002"). The 280 mm, (11") periods of these waves closely matched the alternate actuator streak spacing. Because the dips in the apron floor occurred between actuators, corrections could not be made by slice screw adjustment. Ultimately, the profile of the entire apron floor was measured and plotted on a three dimensional graph, with the same wavy results, as seen in FIG. 2. To put these measurements into perspective, consider that state of the art linear stepper slice actuators are capable of a very high level of precision. One commercially available actuator has a step resolution of 3 micrometers (0.00012") of slice lip movement.

The traditional method of measuring headbox slice profiles relies on a conventional analogue dial test indicator mounted on a brass sled. The sled rides along the apron lip with the test indicator tip contacting the underside of the slice lip. The conventional brass sled was modified to accept a Mitutoyo™ lever head electronic gauge and cable connected to a remote digital readout. The digital readout was in turn connected to a Mitutoyo Digimatic™ Miniprocessor. The Miniprocessor is programmed for statistical process control (SPC) and is equipped with a miniature four pen colour plotter, for producing on-site graphs. In addition, the data can be readily downloaded into a personal computer, through a standard RS-232 port (REF. 5). This equipment quickly measures headbox slice and apron profiles to an accuracy of 1/10 of a micrometer (4 millionths of an inch).

Independent confirmation of the correlation between streak locations and apron floor waviness was obtained with the aid of both hand held and robotic video equipment. Systematic examination of the headbox internals revealed the following potentially significant features:

apron floor wavy in machine and cross machine directions;

pitch deposits at apron floor to headbox joint;

underside slice beam wavy in M.D. and C.D;

stilling chamber wavy floor and ceiling; and, inlet tube irregularities.

A lapping method, which will now be described, was devised in order to attain the desired degree of flatness tolerance on the apron floor. The objective was to eliminate surface irregularities (waviness) in the apron floor, by machining the entire surface flat, to a desired tolerance of 5 micrometers in 250 mm, (0.0002" in 10"). The new surface finish had to be as good or better than the original electropolished surface finish, of 0.1 micrometers (4 RMS).

Lapping is an abrasive machining operation which improves surface quality by reducing defects, roughness and waviness, thus generating an accurate flat, smooth surface. Lapping fundamentals are described in Machinery's Handbook by Oberg & Jones, 11th. Edition, The Industrial Press, New York, U.S.A. (1943), which generally recommends soft materials such as cast iron, copper, brass or lead. To avoid ferrite contamination of the apron floor, 6061-T6 aluminum was selected as a lap material, as it was soft, light weight for ease of handling, readily available and reasonably priced.

In a conventional lapping operation the work piece (i.e. the apron floor in this example) is driven with respect to the lap, which remains stationary. The lap is made of soft material to enable harder particular abrasive granules to become embedded in the lap's working surface. By contrast, the present invention leaves the work piece stationary while the lap is driven on and over the work piece. As explained below, instead of lap-embedded abrasives, the invention utilizes discrete adhesive-backed pads of abrasive material which are adhered to the lap's working surface.

The lap working surface was made 28 inches in diameter, to produce a true plane surface and ensure full coverage of the 27 inch wide apron floor. In practice, the lap's working surface need only have a diameter greater than the dominant wavelength of the surface irregularity (i.e. "waviness") which is to be eliminated. To maintain a stable flat surface, the lap had to be adequately stiff and rigid, so a thick cross section of 3 inches was chosen.

The alternatives of using a rectangular, reciprocating lap or a round, rotating lap were considered. The motion of a rectangular lap would have to oscillate in two axes, similar to an orbital sander, to avoid producing linear scratches. It was felt that this orbital action would be difficult to control manually with this size of lap. A round lap shape was accordingly selected, because it would be easier to drive using conventional motors, without the risk of scratching. The lap was maintained level by driving it through a universal joint, to eliminate the possibility of uneven lap loading, or rocking of the lap to one side which could damage the apron floor.

The working surface of the lap was machined flat to the same 5 micrometer tolerance as desired for the apron floor. Since aluminum does not lend itself well to surface grinding, face milling or facing off on a lathe were considered. Because a face mill has a tendency to produce a slightly dished surface, a precision lathe facing operation used. The accuracy of this facing operation was confirmed using the same Mitutoyo™ electronic measuring equipment as was used on the headbox apron floor, described above.

A cross hatched pattern of grooves for coolant flow and to collect swarf for the working surface of the lap proved to be unnecessary with the adoption of fixed pad type abrasives, as described below, so a simple plain finish was used.

Since the lap's abrasive machining surface speed would be proportional to its diameter, the outer circumferential region of the lap would cut faster than its centre. Therefore, the centre area of the lap was relieved with a ⅛ inch deep by 16 inch diameter counterbore, to ensure a more even range of cutting speeds.

To ensure an adequate supply of filtered cooling water, apertures were drilled through from the top of the lap into its relieved centre area. Coolant introduced through these apertures was accordingly flushed radially outwardly through the abrasive cutting area by centrifugal action, as the lap rotated. The coolant flow rate was maintained at approximately 1–2 GPM.

A variety of abrasive materials are commercially available for microfinishing use in lapping operations. These include aluminum oxide, chrome oxide, silicon carbide, cubic boron nitride and diamond. Since the headbox apron floor of the paper machine described above was made from relatively soft 317-L S.S. alloy, an aluminum oxide abrasive was selected. The other abrasives are more suitable for finishing harder materials and are appreciably more expensive.

For convenience, abrasive material in fixed pad form was used, instead of loose abrasive material such as polishing compounds, pastes and slurries which tend to be messy, compared to microabrasive films which allow cleaner, faster work with more predictable results. 3M™ Quik Strip™ abrasive pads in the form of colour coded "daisies" were used. Such pads provide an aluminum oxide abrasive bonded to a stable, waterproof, uniformly thick adhesive backed film. The pads are supplied in the shape of 3 inch diameter daisies. This provides an open area around the petals, for efficient access of cooling water to flush away cutting fines and spent abrasives. Using these daisies eliminated the need to machine expensive cross hatching grooves in the underside of the aluminum laps.

The following successively finer grits of aluminum oxide abrasives were used, to obtain the equivalent of the original electropolished finish:

1. Brown P-600, ~26 Micrometer, #3M 314
2. Gold 12 Micrometer beaded, #3M 321M
3. Red Raspberry 4 Micrometer beaded, #3M 358M As an initial test, a piece of 316-L S.S. was clamped to a rigid machined surface and flooded with clean fresh water. A small 9 inch diameter by 4 inch thick test lap was made up and driven with an electric drill, through a ½ inch drive universal joint. Various grits of abrasive were tried, all with good results. There was no great difficulty in obtaining the desired polished surface finish, as long as the daisies were changed or cleaned as soon as they showed signs of plugging. The weight of the lap alone was sufficient to maintain an adequate rate of cutting. It was found to be important to keep the area flooded to flush away cuttings and prevent the daisies from plugging. Progress of the lapping operation was visually monitored by watching the contrast of the higher dull areas being cut down, as compared to the lower shiny areas that the lap was not yet touching. These observations were confirmed by the electronic gauge readings.

After successful conclusion of the foregoing test, a wooden support crib for the apron beam was designed and built, to support the headbox apron beam on the machine room floor; to allow the apron beam to be shimmed level to avoid distortion; to protect the apron floor and lip from mechanical damage; to allow the lap to overhang the apron edges; to allow cooling water to drain and flush away cuttings; to provide duckboards for access at a convenient working height; and, to provide bull rails for guiding the laps.

The headbox apron beam was carefully removed and placed into the wooden support crib. The apron lip was protected with a split rubber hose during this process. The apron beam was accurately levelled to eliminate any distortion, prior to lapping. More particularly, the apron beam was allowed to stabilize at machine room temperature and then optically levelled, using a Wild™ N-3 precision level mounted on a heavy instrument stand. Shims were installed as required under the appropriate cribbing frames until the apron floor was level.

The apron floor was measured to record its initial profile, using the electronic gauge as described above. This initial profile was used as a datum reference for comparison with interim profile readings obtained during the lapping operation and to monitor progress of the lapping. The initial apron floor readings showed the same distinctive wavy profile as measured in previous surveys, with maximum amplitudes in the order of 60 micrometers.

In preparation for the lapping operation, a mill fresh water line was fitted with a residential cartridge type filter. This was done to ensure that no contaminants were introduced into the flushing water that could scratch the apron floor. Attempts to drive the heavy (i.e. non-test) lap with electric drill motors were not successful, due to motor overheating.

An air motor was substituted, which had no trouble developing the required torque. With fresh abrasive daisies applied to the lap, it was not uncommon initially to need three men helping to control the torque on the drive handles. To ease the strain, one team would ran the lap while the other team rested and applied fresh abrasive daisies to a second, identical lap. The laps were changed about every 20 to 30 minutes, to get the best cutting rate without wasting time trying to obtain the last bit of life from worn out abrasives.

A Renshaw™ calibration system employing a laser interferometry technique was used to measure the true flatness of the apron floor. This technique detects the reflected angle of a laser beam back onto itself, to determine the absolute flatness of a surface. The system conveniently logs the data into a portable personal computer and displays the results graphically on the monitor screen in real time. The ability to view the profile in real time, versus waiting until all of the readings were taken, was very useful. The graph can also be sent to the system printer, to produce a working hard copy.

The lapping procedure, employing four men, required four 12-hour days, using sequentially finer abrasive grits, from 26 to 12 to 4 micrometers. Using an average of 50 daisies per lap change, approximately 3000 daisies were consumed to complete the job. After the first two full days lapping, the apron floor profile was given an interim check. Using the electronic measuring equipment aforesaid, the profile already showed a significant improvement. The remaining waviness showed maximum peak to valley variations of 18 micrometers (0.0007") and standard deviations in the order of 3 micrometers (0.00012").

Using the large 28 inch diameter lap only on the rectangular apron floor, would have left the four corners untouched. Therefore, the small 9 inch diameter lap, initially used for testing, was employed to lap these corner areas and feather them into the larger lapped area.

Figure 3:
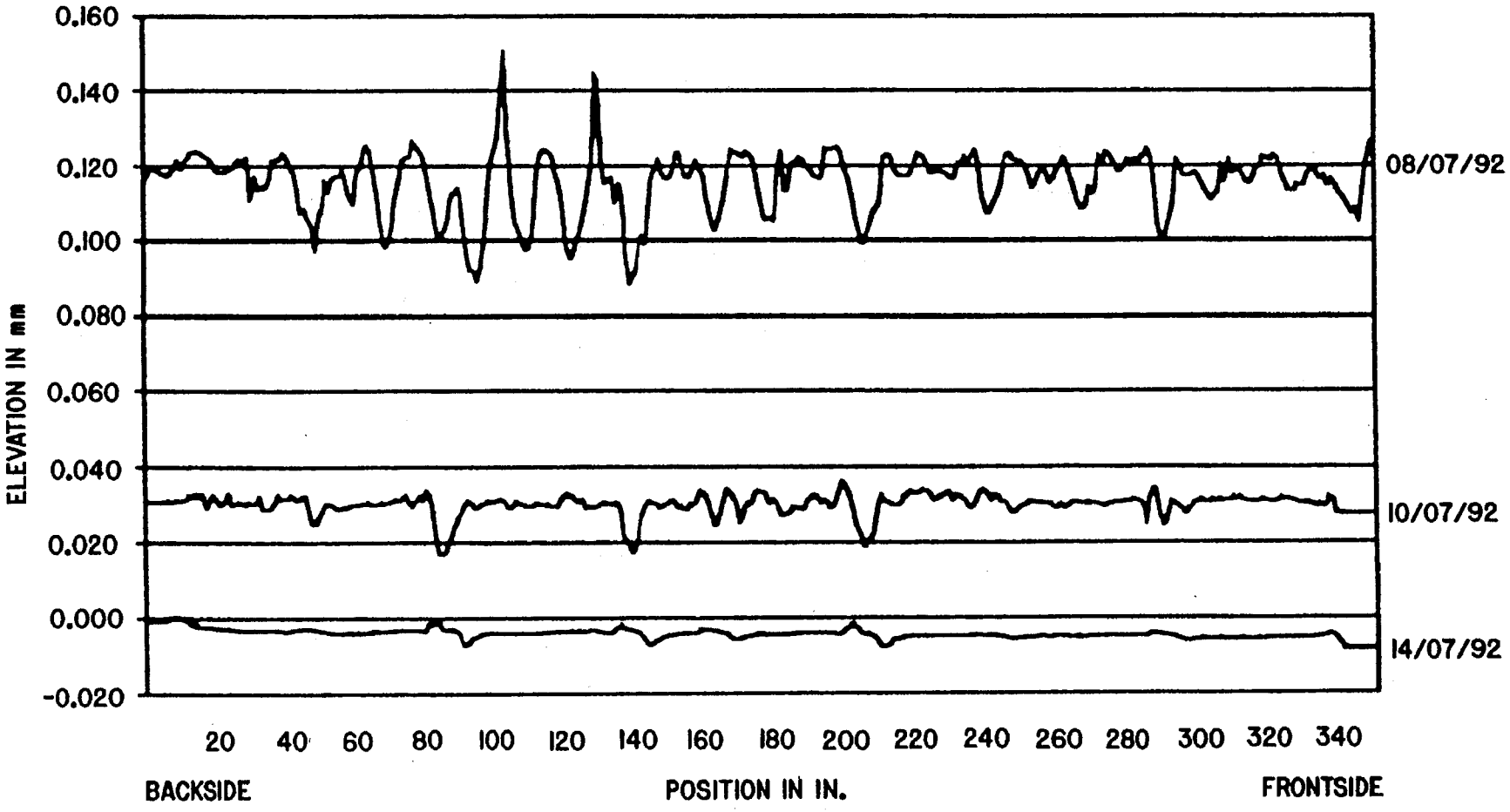
FIG. 3 is a graph depicting paper machine slice opening versus position, after lapping the apron floor in accordance with the invention.
Figure 4:
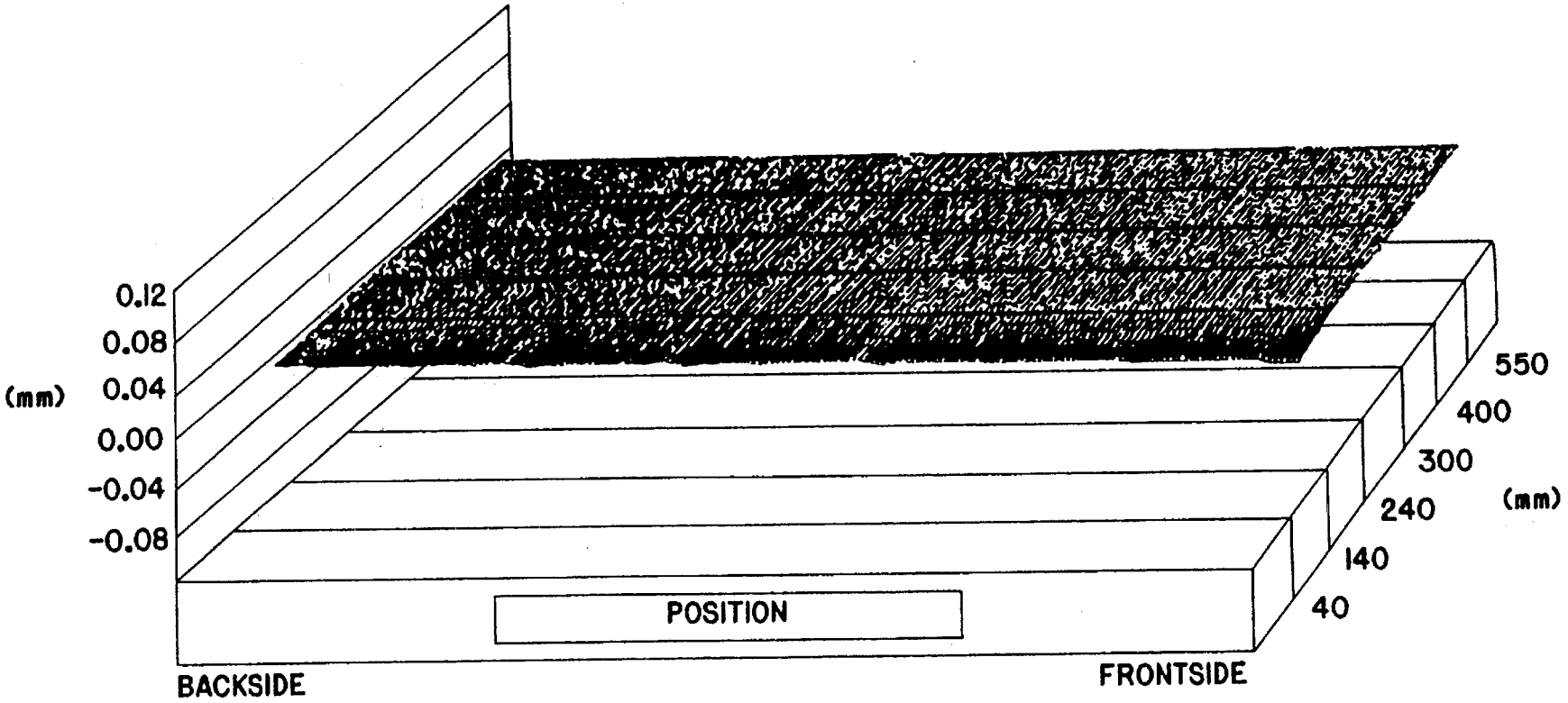
FIG. 4 is a three dimensional graph showing the profile of a paper machine apron floor measured in accordance with the invention, after lapping the apron floor in accordance with the invention.

The final apron floor profile (FIGS. 3 and 4) was measured, after the completion of all lapping. A thorough rinsing was done to ensure that no abrasive particles remained on the apron floor; to avoid scratching with the measuring gauge sled. The final profile showed total variations of only 6 micrometers (0.0002") with a standard deviation of only 0.6 of a micrometer (0.000024"). This exceeded original expectations and provided a reliably flat apron datum for future slice readings.

The effect of apron lapping on the paper streaks was less dramatic. Only two streaks were eliminated, with the remainder staying in their previously recorded positions. However, the magnitude of the streaks was reduced, resulting in a more uniform sheet. This may also have been reflected in the reduction in non uniformity index (N.U.I.) values from 10.5 to the 8.5 range across the reel.

State of the art, computerized, slice actuators are now capable of control resolution to 0.0019 mm (0.000077 inch), with position feedback resolution of only 0.0002 mm (0.000008 inch). A question which often arises is why such fine tolerances are necessary, when these variations constituted such a small proportion of the typical 12.5 mm (0.50 inch) total slice opening? The answer is, that at today's 1370 MPM (4500 FPM) paper machine operating speeds, a change of only 0.025 mm (0.001 inch), at one slice actuator position, is enough to make an obvious basis weight streak in the sheet. Closing the slice another 0.2 mm, (0.008 inch), at the same position can be sufficient to completely clear the stock off the wire in that area. These well documented phenomena are due to the complex wave actions and cross flows, occurring in the jet at very high machine operating speeds.

Although modern paper machine control equipment is capable of working to the required tolerances, the machining of critical headbox components is not always up to the same standards. Since the slice control system can not adjust between actuators, deficiencies in these areas must be corrected; one such corrective technique having been described above. Increasing the number of actuators to reduce the control spacing is often suggested as a solution, but this only addresses the symptoms without correcting the streaking problem at its source.

Correction of small scale basis weight variations in the paper sheet presents a complex problem. No one headbox component is likely to be responsible for all of the streaks. Possible sources of basis weight streaking have been observed to be linked to imperfections in the following headbox components 10, slice beam 12, slice blade 14, actuator rods 16, turbulence generator 18, stilling chamber 20, and inlet tubes 22. A variety of corrective measures have been adopted to relieve basis weight streaking. With respect to the apron beam, these include adjustment of lip levelness; adjustment of the lip square to machine offset centerline; setting of the U/S lip to breast roll clearance; correction of the lip edge condition; checking of the apron hot water heating system; removal of floor matchline pitch deposits; and, correction of floor flatness and surface finish by lapping as described above.

Corrective factors adopted with respect to the slice beam include adjustment of the edge horizontally parallel to the apron; checking of the hot water heating system; adjustment of the edge vertically parallel to the apron; correction of the edge condition; correction of the inclined face flatness and surface finish; correction of the wet face flatness and surface finish; and, correction of the knuckle condition.

Corrective factors adopted with respect to the slice blade include checking of the blade's mechanical properties, such as yield, bend limit and hardness; checking of the blade's physical properties, such as thermal expansion coefficient; setting of end to pondside clearances; removal of back stock accumulations; adjustment of stickdown reduction; checking of metallurgy properties and corrosion resistance; back fretting, electrolysis and lubrication; checking of slice width; correction of back flatness and surface finish; and, correction of edge straightness.

Corrective factors adopted with respect to the actuator rods include correction of backlash in one piece versus two piece rods; correction of rod straightness; improvement of rod stiffness; lubrication of rod to brass clamps; rod centering; crowing of taper lock groove alignment; increase of brass clamp thermal expansion clearances; and, testing of clamp spring pressures and distribution.

Figure 10A:
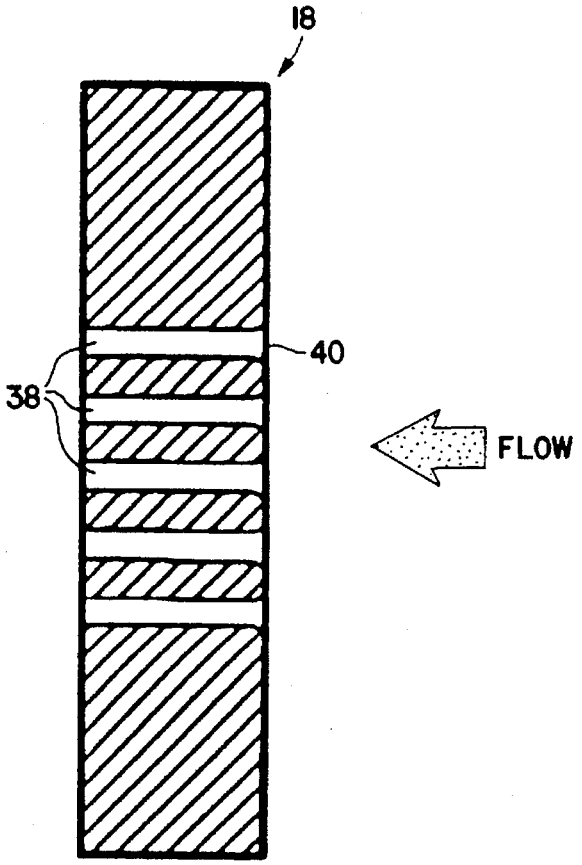
FIGS. 10(*a*) and 10(*b*) are respectively a cross-sectional and a fragmented partial view of the face of the turbulence generator's perforated plate.
Figure 10B:
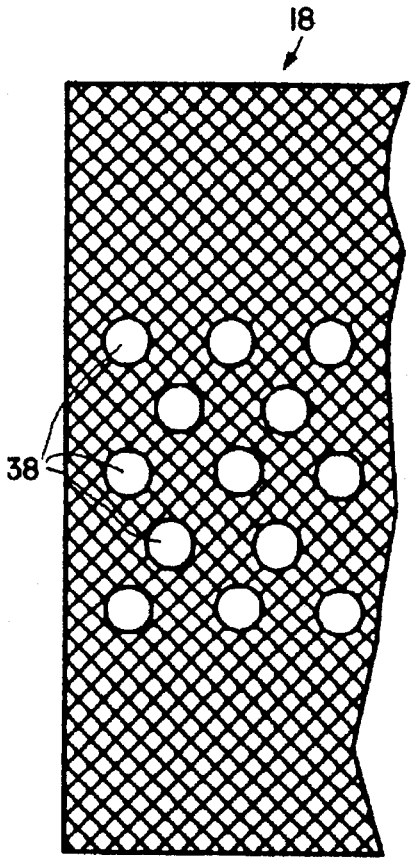

Corrective factors adopted with respect to the turbulence generator 18 (FIGS 10(*a*) and 10(*b*) include checking of perforated plate hole 38 diameters, inlet radius 40 uniformity, hole pattern relative to inlet tube bundle, hole position uniformity, hole alignments normal to perforated plate face, hole surface finish, and tube uniformity.

Corrective factors adopted with respect to the stilling chamber include checking and correction of floor flatness and surface finish, corner joints and ceiling finish. Corrective factors adopted with respect to the inlet tubes include checking that the inlet tubes are flush with header wall; and, checking of roll crimp uniformity.

The foregoing factors provide an overview of the immense scope of the work involved. Typically, thousands of quantitative measurements, to ultra precise tolerances, are taken using optical and electronic metrology equipment. Innovative jigs and fixtures must be custom built to adapt the measuring equipment to headbox applications. All equipment must be designed to avoid scratching the electropolished internal surfaces of the headbox. Video camera inspection techniques, coupled with digitized image analysis, provide further qualitative evidence by revealing small scale variations in the headbox.

Video thermography techniques employing a special camera sensitive to heat, instead of light were adapted to monitor the streaking problem, from press to reel, while the paper machine was running. The camera was adjusted to suit the emissivity of the surface observed, allowing temperature differences to be observed as colour variations.

Digital video camera inspection techniques using triple CCD (charge coupled device) technology, were used to obtain distortion free images of superior quality and resolution. Halogen "broom" lighting provided clear contrasts, while a telephoto lens ensured a flat image. These images were then digitized for detailed computer analysis, to an accuracy of 0.1 mm (0.004 inch), in a manner similar to using an optical comparator. This technique proved useful for inspection of the apron floor joint, turbulence generator perforated plate, and inlet tube bank.

Optical tooling employing first order precision levels, theodolites and autocollimation telescopes, was used to measure vertical and horizontal displacements, to an accuracy of 0.025 mm (0.001 inch). This technique proved useful for inspection of the apron lip elevations, apron lip horizontal alignment, and slice back flatness.

Electronic gauging using sensitive transducers, connected to remote digital readouts and miniprocessors, was used to measure surface variations to an accuracy of 0.0001 mm (0.000004 inch). This technique proved useful for inspection of the reel spool paper profile, apron flatness, slice opening, slice width, slice beam to apron parallelism, and turbulence generator perforated plate hole diameters.

Laser interferometry was employed, as previously described, to determine variations from absolute straightness, over the width of the headbox, to an accuracy of 0.00001 mm (0.0000004 inch). This technique proved useful for inspection of the apron floor flatness and apron lip straightness.

Since established precedents for measuring headboxes to such close tolerances are unavailable, it is not always clear what degree of variation constitutes a problem. However, repeated correlations of even seemingly insignificant headbox deficiencies, with known streak locations, can serve to identify problem areas. Comprehensive historical documentation of measurement results facilitates reliable correlation of component defects with basis weight streak locations.

The logistics of collecting and processing vast amounts of measurement data, were simplified by using computer analysis and CAD graphics. Field measurements were conveniently collected using a portable miniprocessor, with statistical process control (SPC) logic. A built-in four pen colour plotter allowed instantaneous graphing of results, complete with printouts of all statistical parameters. Data was efficiently downloaded from the field miniprocessor to a computer-aided drafting station where subtle measurement variations could be discerned by sizing graph scales to show important details. By overlaying actuator grids with streak locations, suspected correlations could be confirmed or ruled out.

Figure 5:
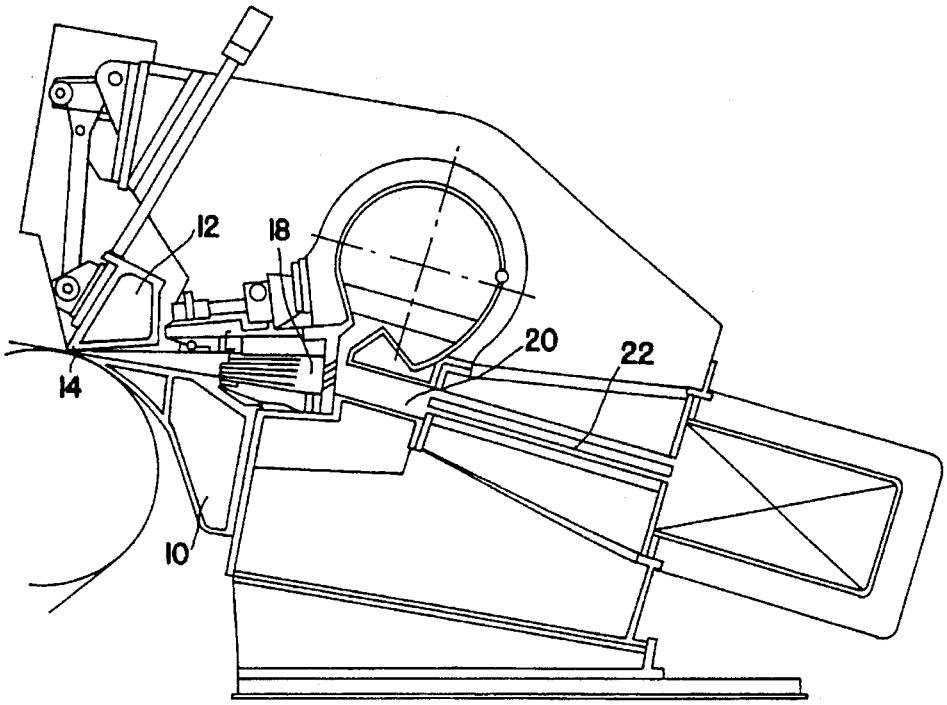
FIG. 5 is a cross sectional illustration of a paper machine headbox, showing its various components.
Figure 6:
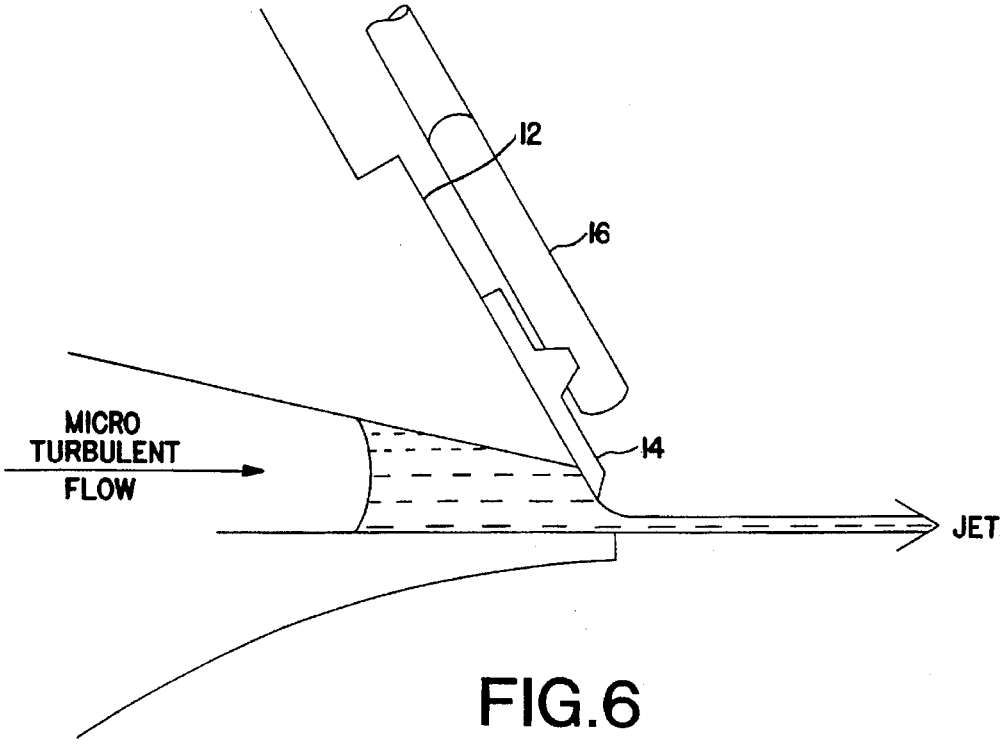
FIG. 6 is a cross-sectional illustration of a paper machine headbox slice area, showing its various components.
Figure 7:
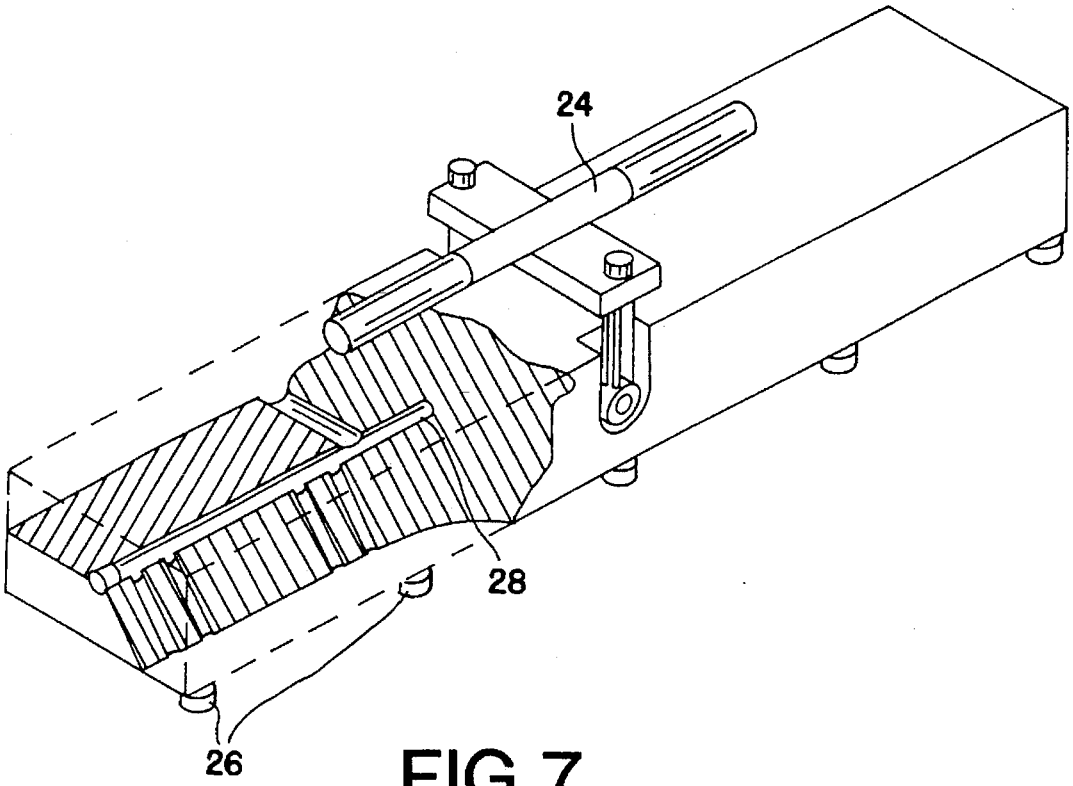
FIG. 7 is a pictorial illustration showing details of the slice beam lapping operation.

The inclined face of the headbox slice beam 12. (FIGS. 5 and 6) against which the slice blade 14 is clamped, was also lapped flat using the technique described above with respect to the apron floor. This application required rectangular, reciprocating laps, manually driven through a pivoting "tee" handle, again to ensure self levelling (FIG. 7). Three identical laps were machined and lapped to each other in the classic method, to produce true flat surfaces. One lap was fitted with an electronic gauge and retained for measuring purposes. The weight of each lap was supported by a series of cam followers 26, mounted along the top edge of the lap face, allowing easy cross machine travel. The laps were through drilled and cross drilled, thus creating a manifold 28 for provision of flushing water to the lapping surface.

Figure 8:
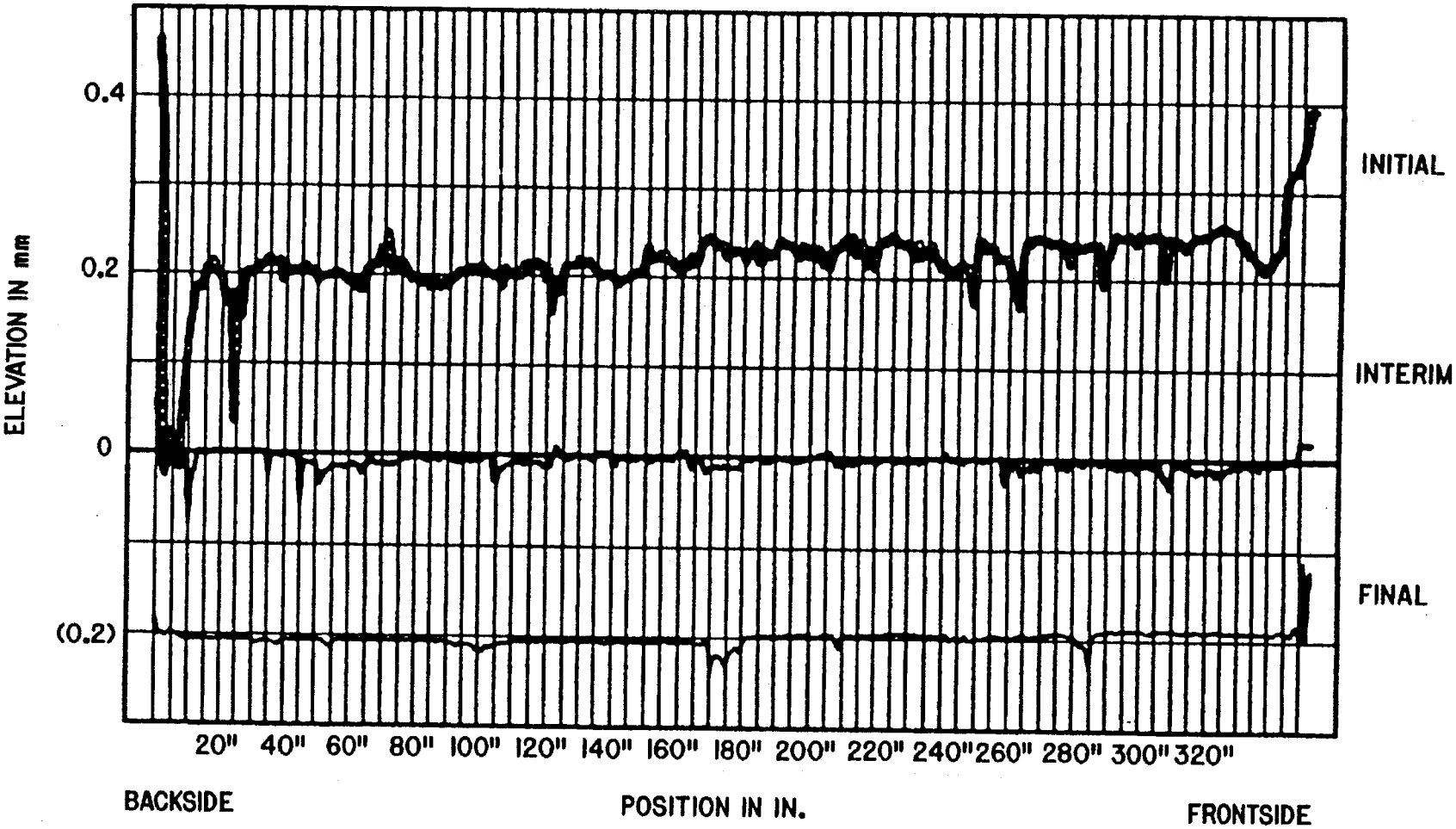
FIG. 8 is a graph depicting slice beam elevation versus position, after lapping the slice beam in accordance with the invention.

After 24 hours of lapping, the surface flatness variations were again successfully reduced from an initial 0.050 mm (0.002 inch), to the desired range of 0.005 mm (0.0002 inch) (FIG. 8). The original milled surface finish was also dramatically improved to a mirror finish. This resulted in the elimination of six more prevalent basis weight streaks, plus a reduction in the usual number of paper breaks caused by light edges.

A prototype, precision slice blade, lapped straight and flat to the required tolerance of 0.005 mm over 250 mm (0.0002 inch over 10 inches), was obtained from Beloit Canada Ltd. Stringent quality control meant devising new jigs and fixtures to hold not only the slice, but the electronic gauging required to measure it. The successfully completed slice was shipped to the mill site inside a padded, hollow structural steel tube. This was to avoid any possibility of freight damage, often encountered with typical slice shipping crates made from wood.

Installation of the new precision slice resulted in a reduction of the 2 sigma basis weight variations from a previous best average of 2.8 g/m$^2$ (0.57 lb/1000 sq. ft.), down to the present average of 2.2 g/m$^2$ (0.45 lb/1000 sq. ft.).

Figure 9:
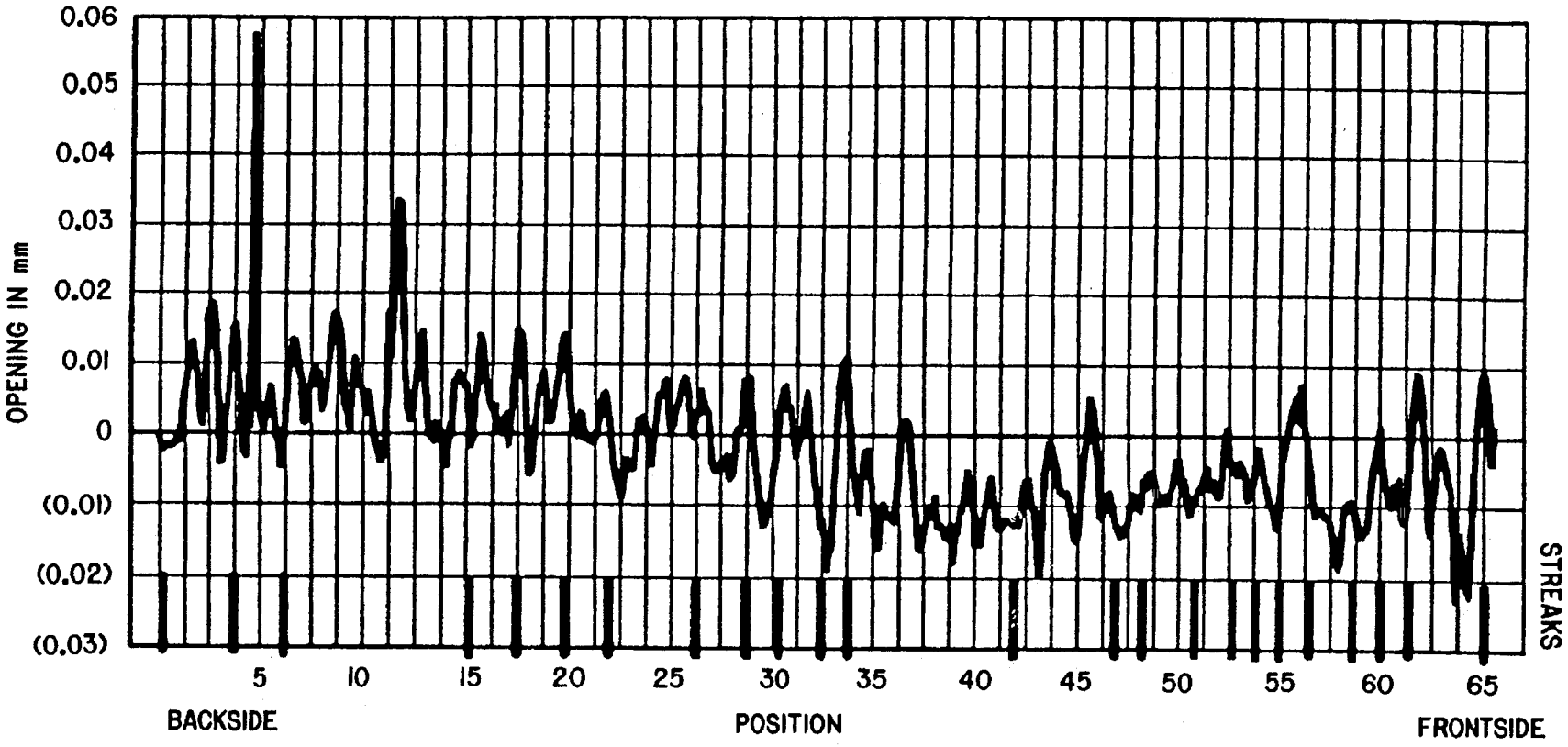
FIG. 9 is a graph depicting slice opening versus streak locations, after installation of a precision manufactured slice blade, with streak locations superimposed.

In spite of these encouraging improvements, the streaking problem persists to a reduced degree. Inter-actuator slice opening variations still exist, but their correlation with streak locations is now reduced to only 58% (FIG. 9).

Figure 11:
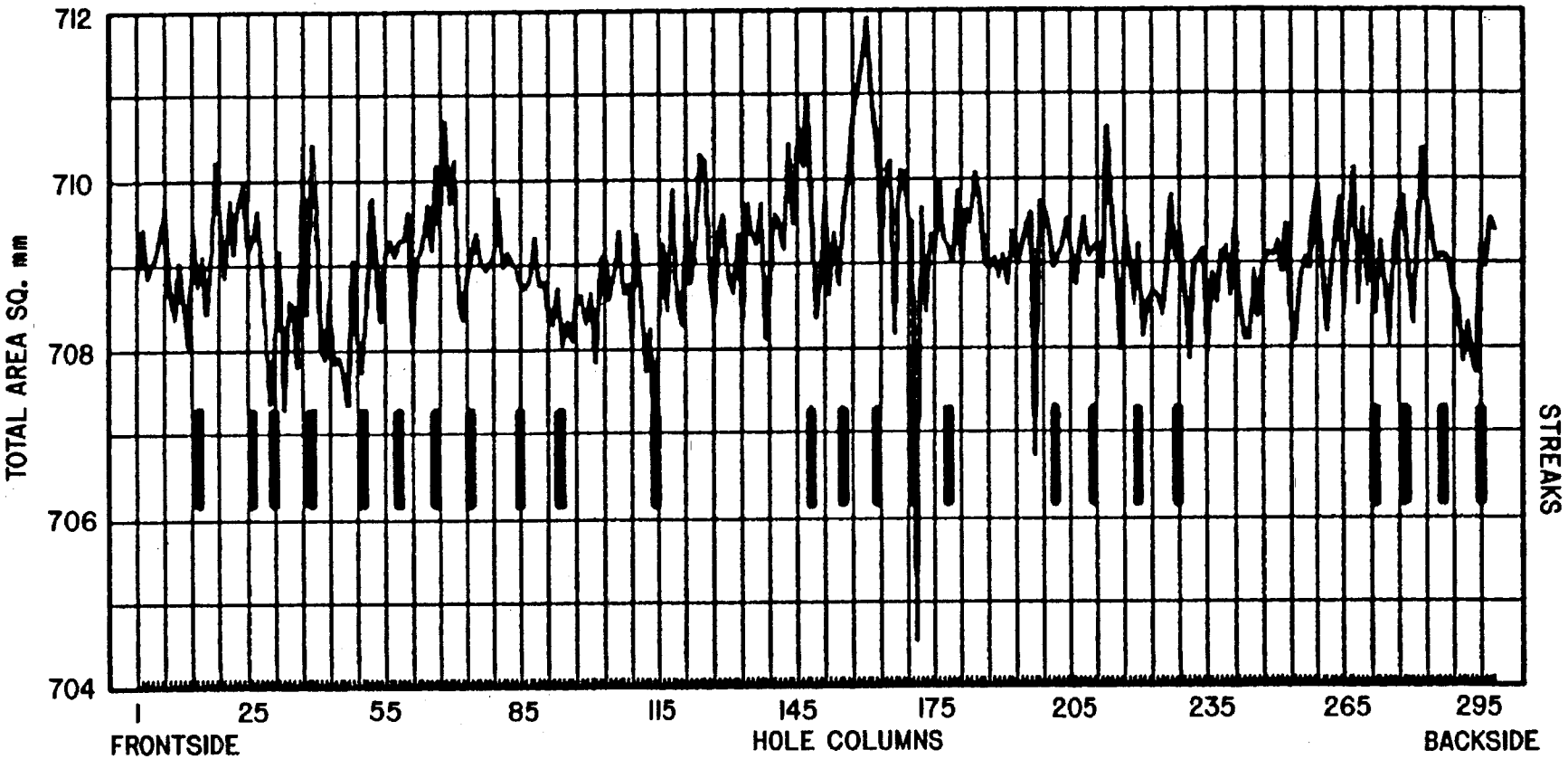
FIG. 11 is a graph depicting turbulence generator hole cross-sectional areas opening versus hole columns, with streak locations superimposed.

Additional investigations centered around imperfections found in the perforated plate holes and inlet radii, of the turbulence generator (FIG. 10). Twelve hundred (1200) of the total fifteen hundred (1500) hole inlet diameters were measured with an electronic hole gauge. Hole diameter variations averaged 0.064 mm (0.0025 inch). These hole inlet diameters were then converted to cross-sectional areas. Being proportional to flow, these areas were added in columns of holes across the machine. These area sums were then graphed to show flow variations for groups of holes (FIG. 11). Prevailing streak locations superimposed on this graph, revealed a better than 80% correlation of streaks to high flow areas.

Video inspection of the hole inlet radii provided further evidence of non-uniformities related to streak locations. The significance of hole inlet diameter and inlet radii variations is well supported and provides ample justification for corrective machining. Precision jig boring of the turbulence generator perforated plate holes can be used to eliminate irregularities found in the critical inlet diameters and radii. A custom jig boring procedure, complete with tooling and equipment, can be used to finish all 1500 holes to a uniform diameter and inlet radius. The objective is to optimize CD flow consistency in the downstream convergent nozzle section.

Figure 12:
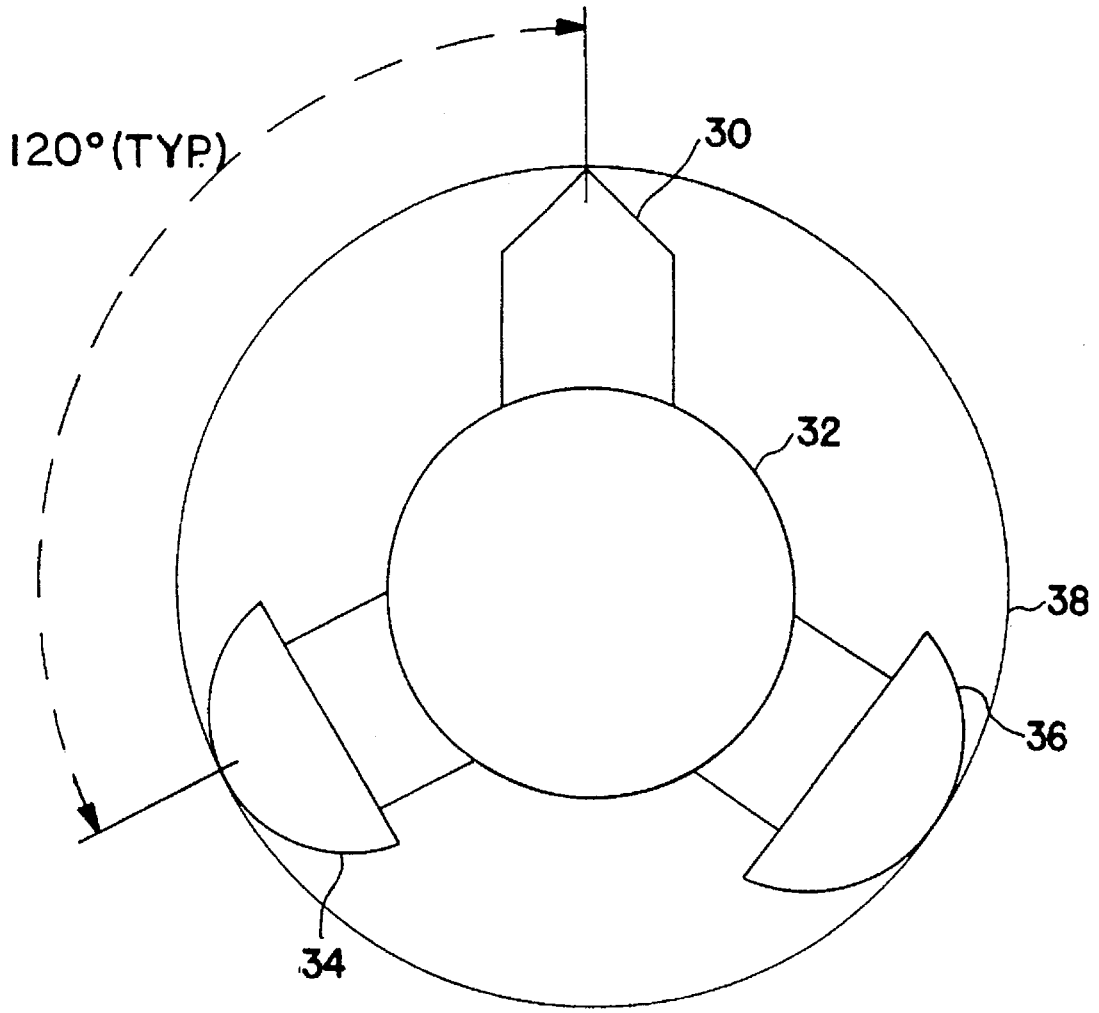
FIG. 12 is a cross-sectional illustration of a jig boring tool.

The machining operation can employ a single point boring tool 30, mounted in a specialized shank 32, fitted with two heel pads 34, 36 oriented at 120° spacing from the cutter (FIG. 12). The pads act as steady rests, supporting the cutter against lateral deflection, while simultaneously imparting a burnished finish to the plate hole bore walls 38. A countersink cutter, integral with the tool shank forms a uniformly deep and concentric inlet radius at the completion of each bore. Continuous flushing with filtered cutting fluid ensures efficient cutting and chip removal.

As will be apparent to those skilled in the art in the light of the foregoing disclosure, many alterations and modifications are possible in the practice of this invention without departing from the spirit or scope thereof. For example, the methodology herein described can be applied to other headbox components, such as the slice beam wet face which forms the ceiling of the convergent nozzle section, the slice blade back or wet faces, or other internal wetted surfaces. Accordingly, the scope of the invention is to be construed in accordance with the substance defined by the following claims.

What is claimed is:

1. A method of reducing streaking in paper produced by a paper machine having a headbox slice beam clamp face, said method comprising the steps of:

(a) measuring said slice beam clamp face to obtain an initial profile of surface irregularity as a function of position on said slice beam clamp face;

(b) lapping said slice beam clamp face by driving a lap levelly on and over said slice beam clamp face while applying abrasive material and coolant therebetween;

(c) measuring said slice beam clamp face to obtain an updated profile of surface irregularity as a function of position on said slice beam clamp face; and, (d) repeating steps (b) and (c) with progressively finer grades of said abrasive material until comparison of said initial and updated profiles reveals attainment or a desired flatness tolerance of said slice beam clamp face.

2. A method as defined in claim 1, wherein said lap driving step further comprises reciprocating said lap linearly relative to a longitudinal axis of said slice beam clamp face.

3. A method of reducing streaking in paper produced by a paper machine having a headbox turbulence generator containing a plurality of perforated plate holes, said method comprising the steps of:

(a) measuring said hole diameters to obtain a cross-sectional area for each of said holes;

(b) summing said cross-sectional areas for column-aligned groups of said holes to obtain an initial profile of said streaking as a function of position of each of said column-aligned groups of said holes;

(c) precision boring said holes;

(d) measuring said hole diameters to obtain an updated profile of said streaking as a function of position of each of said column-aligned groups of said holes; and, (e) repeating steps (c) and (d) until comparison of said initial and updated profiles reveals attainment of a desired reduction in correlation between said streaking and position of said column-aligned groups of said holes.

4. A method as defined in claim 3, wherein each of said perforated plate holes has an inlet having an inlet profile, said method further comprising, during said precision boring of said holes, simultaneously precision counterboring said inlet profiles.

5. A method of reducing streaking in paper produced by a paper machine having a headbox turbulence generator containing a plurality of perforated plate holes, said method comprising the steps of:

(a) measuring said hole diameters to obtain a cross-sectional area for each of said holes;

(b) summing said cross-sectional areas for column-aligned groups of said holes to obtain an initial profile of said streaking as a function of position of each of said column-aligned groups of said holes;

(c) precision boring selected ones of said holes;

(d) measuring said hole diameters to obtain an updated profile of said streaking as a function of position of each of said column-aligned groups of said holes; and, (e) repeating steps (c) and (d) for additional selected ones of said holes until comparison of said initial and updated profiles reveals attainment of a desired reduction in correlation between said streaking and position of said column-aligned groups of said holes.

6. A method as defined in claim 5, wherein each of said perforated plate holes has an inlet having an inlet profile, said method further comprising, during said precision boring of said selected holes, simultaneously precision counterboring said selected holes' inlet profiles.

7. A method of reducing streaking in paper produced by a paper machine having a headbox stilling chamber, said chamber having a floor surface, said method comprising the steps of:

(a) measuring said floor surface to obtain an initial profile of floor surface irregularity as a function of position on said floor;

(b) lapping said floor surface by driving a lap levelly on and over said floor surface while applying abrasive material and coolant therebetween;

(c) measuring said floor surface to obtain an updated profile of floor surface irregularity as a function of position on said floor; and, (d) repeating steps (b) and (c) with progressively finer grades of said abrasive material until comparison of said initial and updated profiles reveals attainment of a desired flatness tolerance of said floor surface.

8. A method as defined in claim 5, wherein said lap driving step further comprises reciprocating said lap linearly relative to a longitudinal axis of said floor surface.

9. A method of reducing streaking in paper produced by a paper machine having a headbox component surface, said method comprising the steps of:

(a) measuring said component surface to obtain an initial profile of surface irregularity as a function of position on said component;

(b) lapping said component surface by reciprocating said lap linearly relative to a longitudinal axis of said surface while applying abrasive material and coolant therebetween;

(c) measuring said component surface to obtain an updated profile of surface irregularity as a function of position on said component surface; and, (d) repeating steps (b) and (c) with progressively finer grades of said abrasive material until comparison of said initial and updated profiles reveals attainment of a desired flatness tolerance of said component surface.

10. A method of reducing streaking in paper produced by a paper machine having a headbox turbulence generator containing a plurality of perforated plate holes, each of said holes having an inlet profile, said method comprising the steps of:

(a) measuring said inlet profiles to obtain an initial indication of imperfection for each of said inlet profiles;

(b) precision counterboring said inlet profiles to reduce said imperfections;

(c) measuring said inlet profiles to obtain an updated indication of imperfection for each of said inlet profiles; and, (d) repeating steps (b) and (c) until comparison of said initial and updated indications reveals attainment of a desired level of reduction of said imperfections.

11. A method as defined in claim 10, further comprising, (a) measuring said hole diameters to obtain a cross-sectional area for each of said holes;

(b) summing said cross-sectional areas for column-aligned groups of said holes to obtain an initial profile of said streaking as a function of position of each of said column-aligned groups of said holes;

(c) precision boring said holes;

(d) measuring said hole diameters to obtain an updated profile of said streaking as a function of position of each of said column-aligned groups of said holes; and, (e) repeating steps (c) and (d) until comparison of said initial and updated profiles reveals attainment of a desired reduction in correlation between said streaking and position of said column-aligned groups of said holes.

12. A method as defined in claim 10, further comprising, (a) measuring said hole diameters to obtain a cross-sectional area for each of said holes;

(b) summing said cross-sectional areas for column-aligned groups of said holes to obtain an initial profile of said streaking as a function of position of each of said column-aligned groups of said holes;

(c) precision boring selected ones of said holes;

(d) measuring said hole diameters to obtain an updated profile of said streaking as a function of position of each of said column-aligned groups of said holes; and, (e) repeating steps (c) and (d) for additional selected ones of said holes until comparison of said initial and updated profiles reveals attainment of a desired reduction in correlation between said streaking and position of said column-aligned groups of said holes.

* * * * *